US007661858B2

(12) United States Patent
Chuang

(10) Patent No.: US 7,661,858 B2
(45) Date of Patent: Feb. 16, 2010

(54) QUICK CONNECT/DISCONNECT BICYCLE POWER PACK

(76) Inventor: Louis Chuang, 8th Floor-4, No. 20, Ta Lon Road, Taichung (TW)

( * ) Notice: Subject to any disclaimer, the term of this patent is extended or adjusted under 35 U.S.C. 154(b) by 247 days.

(21) Appl. No.: 11/835,512

(22) Filed: Aug. 8, 2007

(65) Prior Publication Data

US 2007/0268658 A1 Nov. 22, 2007

Related U.S. Application Data

(63) Continuation-in-part of application No. 11/164,148, filed on Nov. 11, 2005, now abandoned.

(51) Int. Cl.
*F21L 4/00* (2006.01)

(52) U.S. Cl. ..... 362/474; 362/191; 362/396

(58) Field of Classification Search ..... 362/473, 362/474, 475, 476, 183, 396, 157, 190, 191, 362/194; 361/679.23, 601, 679
See application file for complete search history.

(56) References Cited

U.S. PATENT DOCUMENTS 3,828,201 A 8/1974 Allen, Sr.
4,325,108 A * 4/1982 Spingler ..... 362/183
4,334,190 A * 6/1982 Sochaczevski ..... 324/171
5,641,220 A 6/1997 Sutherland et al.
5,833,534 A 11/1998 Lai
5,842,714 A * 12/1998 Spector ..... 280/288.4
6,805,473 B2 10/2004 Beard
7,070,295 B1 * 7/2006 Lee ..... 362/191
7,192,169 B2 3/2007 Takeda
2005/0121935 A1 * 6/2005 Bell ..... 296/78.1
2005/0243542 A1 11/2005 Kim

OTHER PUBLICATIONS

Taiwan Patent Publication No. M263287.

* cited by examiner

*Primary Examiner*—Bao Q Truong
(74) *Attorney, Agent, or Firm*—Alan Kamrath; Kamrath & Associates PA

(57) ABSTRACT

A quick connect/disconnect bicycle power pack includes a mounting device mounted on a bicycle and a spare power pack having a mounting portion adapted for quick attachment/detachment with the mounting device. The spare power pack is adapted to connect to and supply electricity to a plurality of electrically-powered accessories, such as a flashlight, a stop watch, and a loudspeaker.

16 Claims, 7 Drawing Sheets

QUICK CONNECT/DISCONNECT BICYCLE POWER PACK

CROSS REFERENCE

The present application is a continuation-in-part application of U.S. patent application Ser. No. 11/164,148, filed on Nov. 11, 2005, abandoned, of which the entire disclosure is incorporated herein.

BACKGROUND OF THE INVENTION

1. Field of the Invention

The present invention relates to a power pack for a bicycle, and, in particular, to a quick connect/disconnect spare power pack.

2. Description of the Related Art

Referring to U.S. Pat. No. 5,641,220 entitled portable headlamp, the headlamp is electrically connected to and powered by an external battery pack that is secured around the horizontal crossbar of a bicycle frame. The external battery pack accommodates the greater power requirements of the headlamp in a riding situation, such as off-road riding. However, the external battery pack is not only bulky but also heavy so as not to be conveniently portable. Thus, a rider is not inclined to remove the external battery pack from the bicycle when the bicycle is left unattended. As a result, the external battery pack is at risk of theft. Furthermore, since the external battery pack is heavy, it becomes a disadvantage when the rider is racing against time. Furthermore, bicycle accessories, such as a stop watch and a loudspeaker, which also run on electricity, are not disclosed or even suggested.

The present invention is, therefore, intended to obviate or at least alleviate the problems encountered in the prior art.

SUMMARY OF THE INVENTION

A quick connect/disconnect bicycle power pack includes a mounting device mounted on a bicycle and a spare power pack having a mounting portion adapted for quick attachment/detachment with the mounting device. The spare power pack is adapted to connect to and supply electricity to a plurality of electrically-powered accessories, such as a flashlight, a stop watch, and a loudspeaker.

It is an objective of this invention to provide a spare power pack that is adapted to connect to and supply electricity to a plurality of electrically-powered accessories.

It is an objective of this invention to provide a spare power pack that has a mounting portion adapted for quick attachment/detachment with the bicycle.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
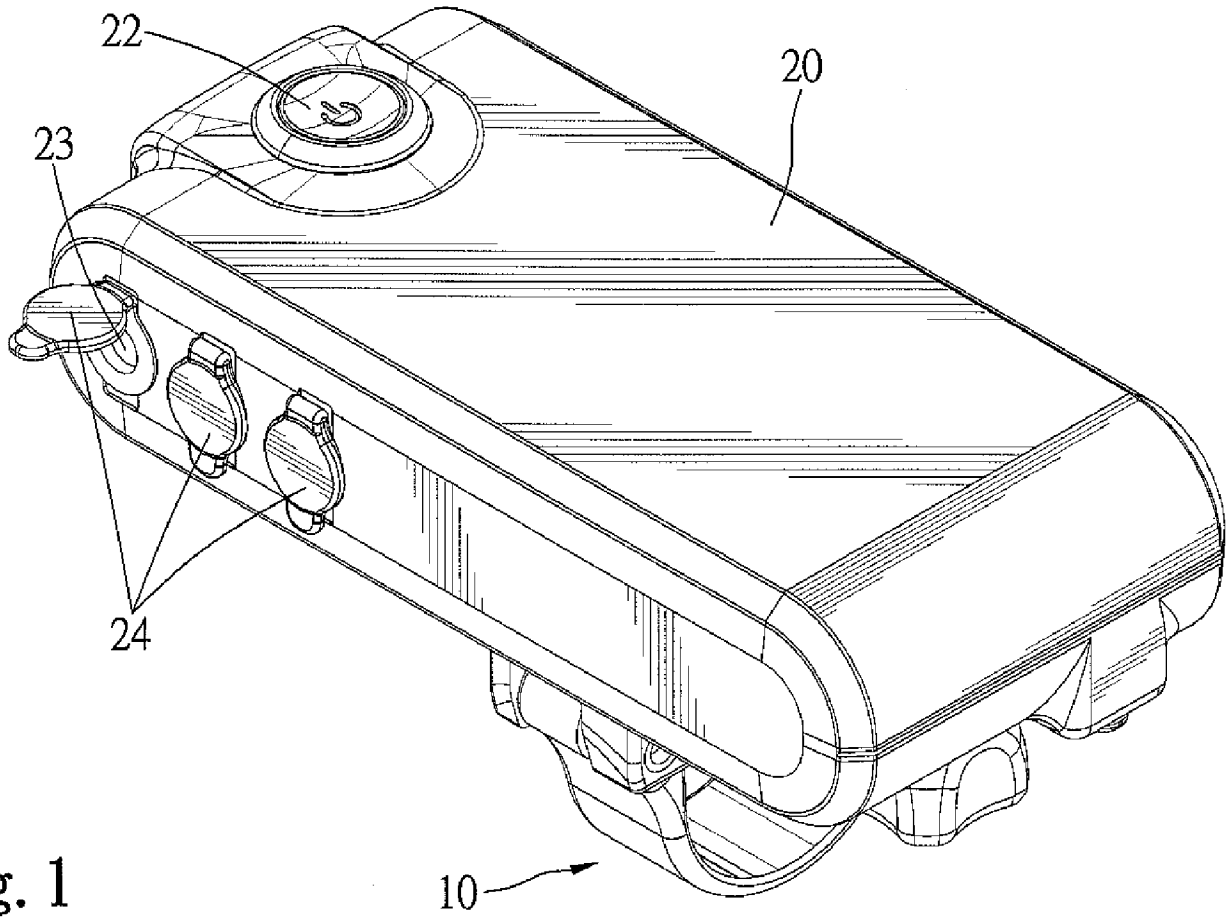
FIG. 1 is a perspective view of a quick connect/disconnect bicycle power pack embodying the present invention.
Figure 2:
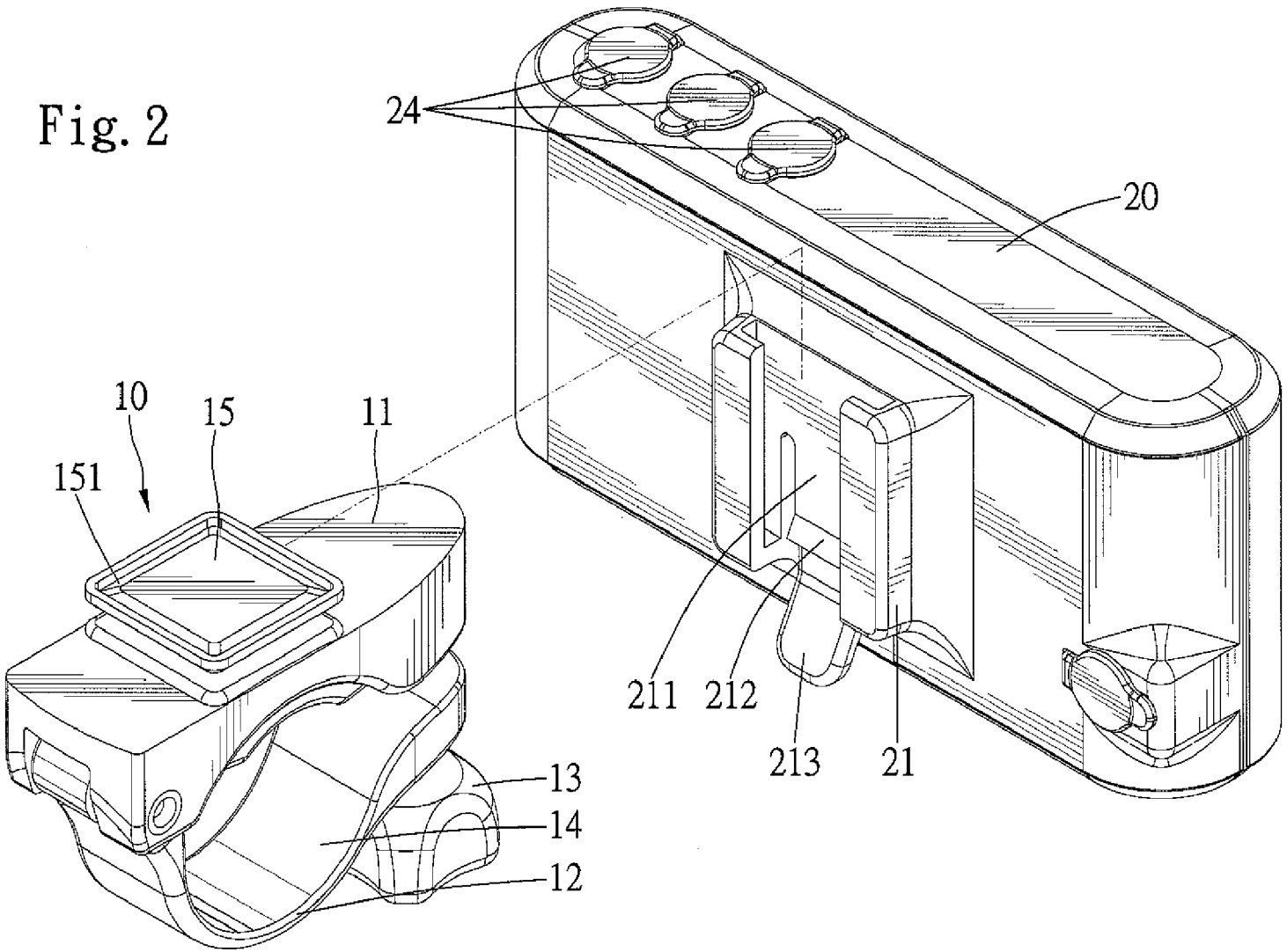
FIG. 2 is another perspective view of the quick connect/disconnect bicycle power pack embodying the present invention.
Figure 3:
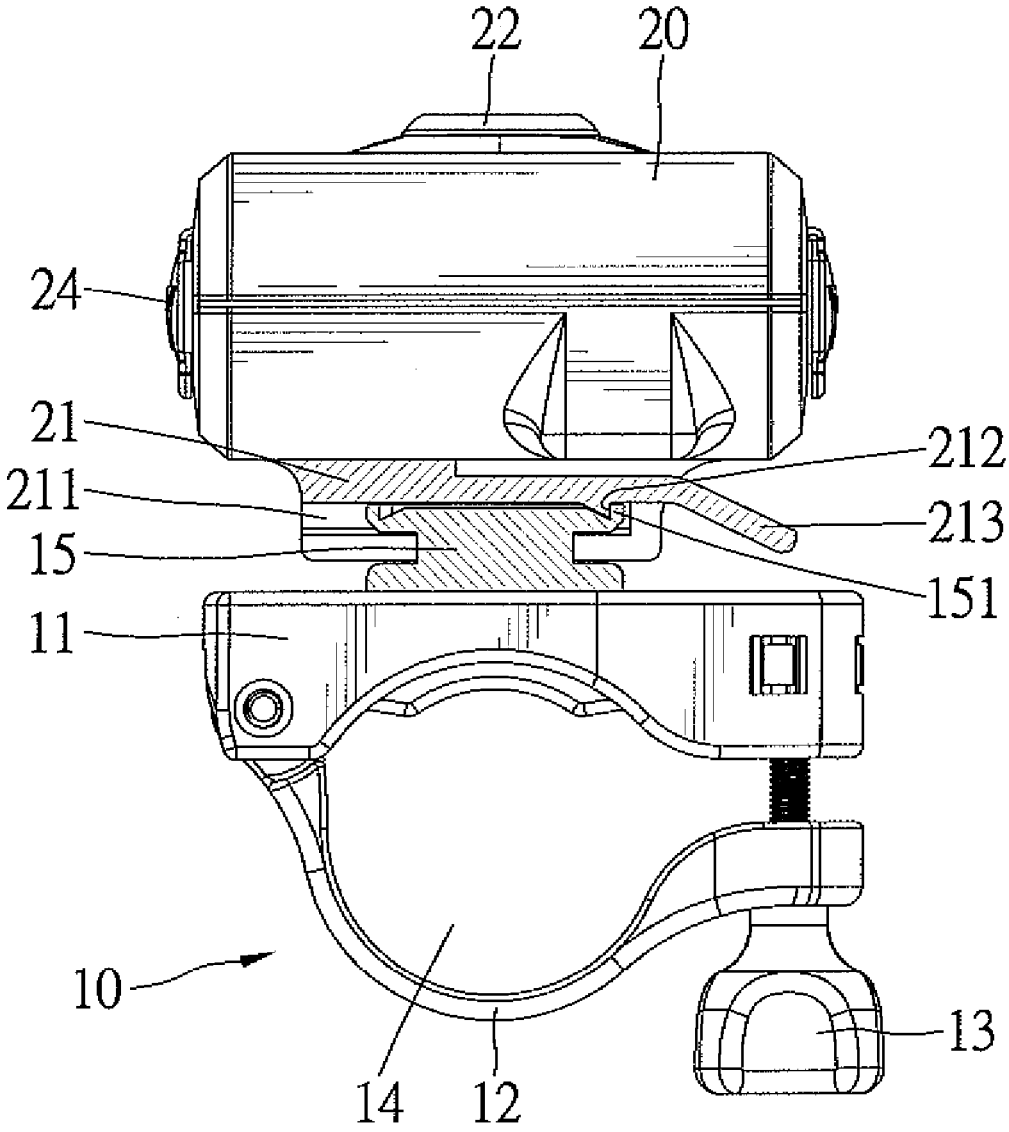
FIG. 3 is a side elevation, partial sectional view of the quick connect/disconnect bicycle power pack embodying the present invention.

Referring to FIGS. 1 through 4, a quick connect/disconnect bicycle power pack includes a mounting device 10 adapted to be mounted on a bicycle 30 and a spare power pack 20 having a mounting portion 21 adapted for quick attachment/detachment with the mounting device 10. The mounting device 10 includes a saddle 11 having a first end and a second end. A brace 12 is pivotally connected to the first end of the saddle 11 such that the second end pivotally moves between various positions relative to the brace 12. Thus, to fix the mounting device 10 on the bicycle 30, the second end of the saddle 11 is pivoted away from the brace 12 for receiving any of a number of different areas of the bicycle 30, such as a handlebar 31, in a space 14 defined therebetween. A fastener 13 which may include a threaded section is thereafter inserted through the brace 12 and the second end of the saddle 11 thereby fixing the mounting 10 on the bicycle 30. The mounting device 10 also includes a clipping member 15 formed on the saddle 11. The clipping member 15 is provided for quick attachment/detachment with the spare power pack 20. The clipping member 15 includes an engaging slot 151 defined at a terminal end thereof.

Figure 4:
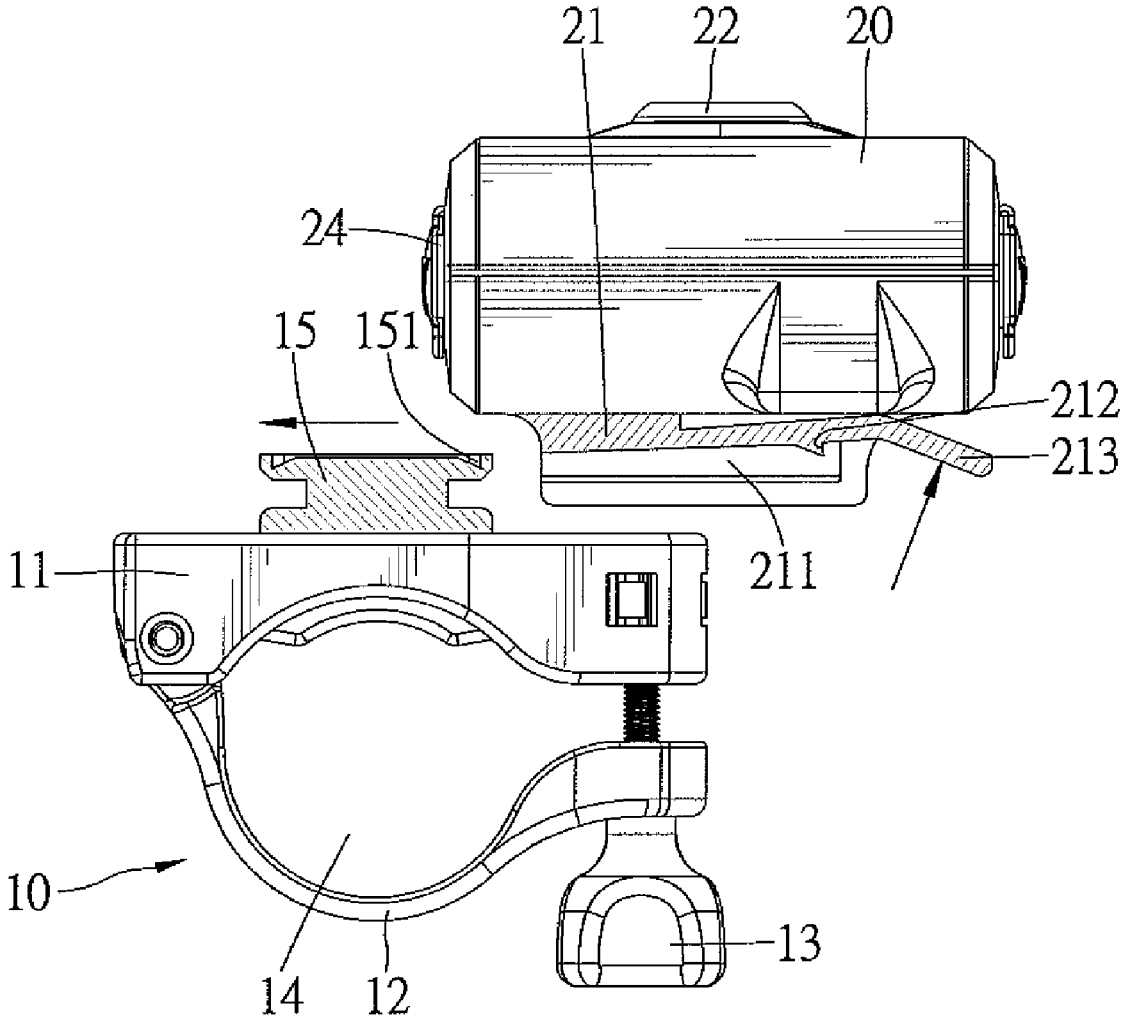
FIG. 4 is a side elevation, partial sectional view illustrating the operation of the quick connect/disconnect bicycle power pack embodying the present invention.

The mounting portion 21 of the spare power pack 20 is adapted to engage with the clipping member 15. The mounting portion 21 includes an engaging recess 211, a locking member 212 disposed in the engaging recess 211, and a biasing member 213. When the spare power pack 20 is connected to the mounting device 10, the clipping member 15 is slidably engaged in the engaging recess 211, and the locking member 212 is engaged in the engaging slot 151. When the spare power pack 20 is to be disconnected from the mounting device 10, the biasing member 213 is pressed in the direction indicated by the arrow, as shown in FIG. 4. Thus, the locking member 212 is biased away from the engaging slot 151, and the mounting portion 21 of the spare power pack 20 can be slid off the clipping member 15 of the mounting device 10.

A power switch 22 and a plurality of outlets 23 are also defined on the spare power pack 20. The power switch 22 is provided for turning on/off the power supply of the spare power pack 20. The plurality of outlets 23 are provided for allowing a plurality of electrically-powered accessories to connect thereto. In addition, each outlet 23 has a protective cover 24 for preventing foreign matters getting into the outlet 23.

Figure 5:
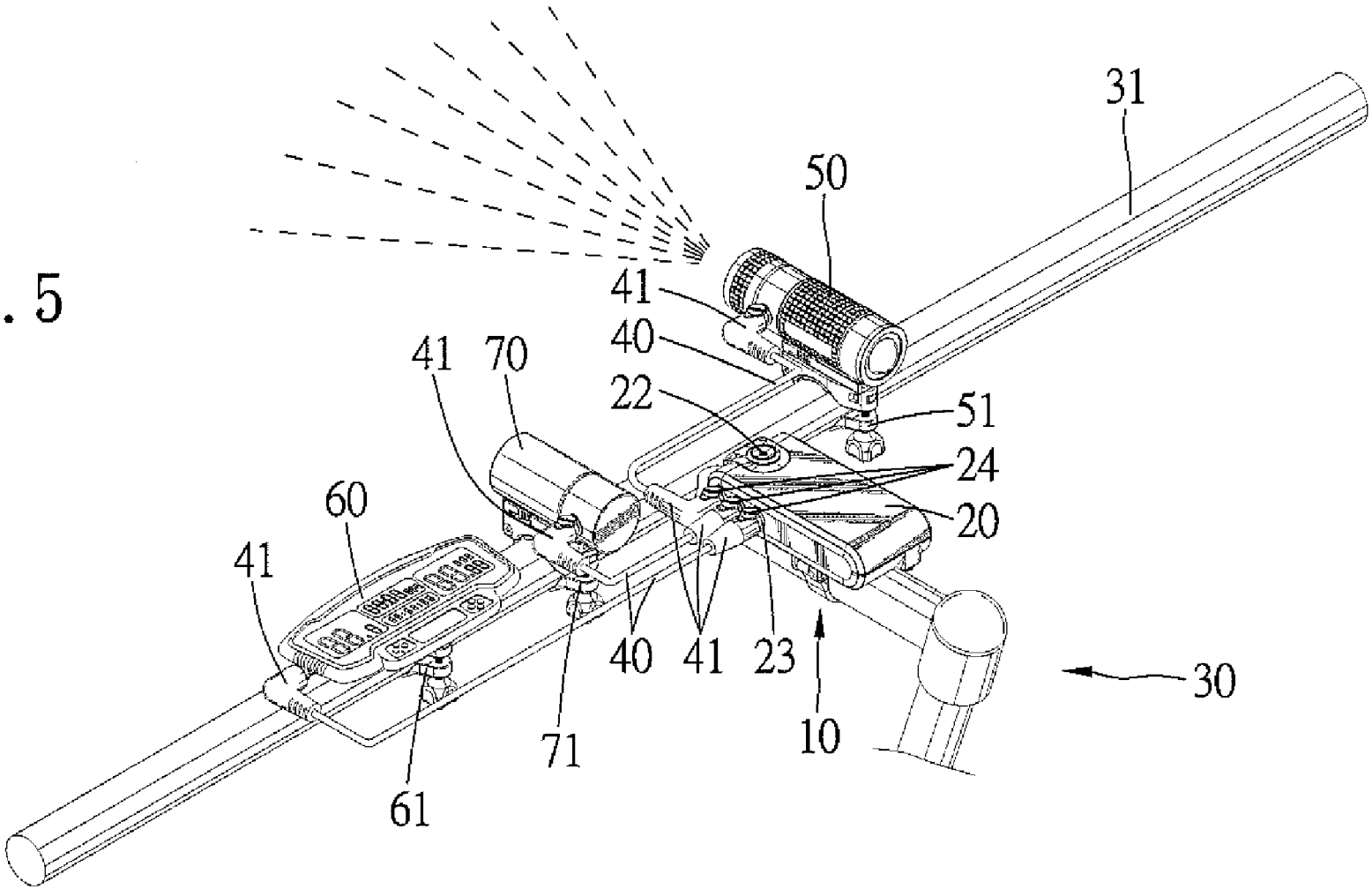
FIG. 5 is a perspective view illustrating the quick connect/disconnect bicycle power pack embodying the present invention and connected to electrical accessories associated with a bicycle.
Figure 6:
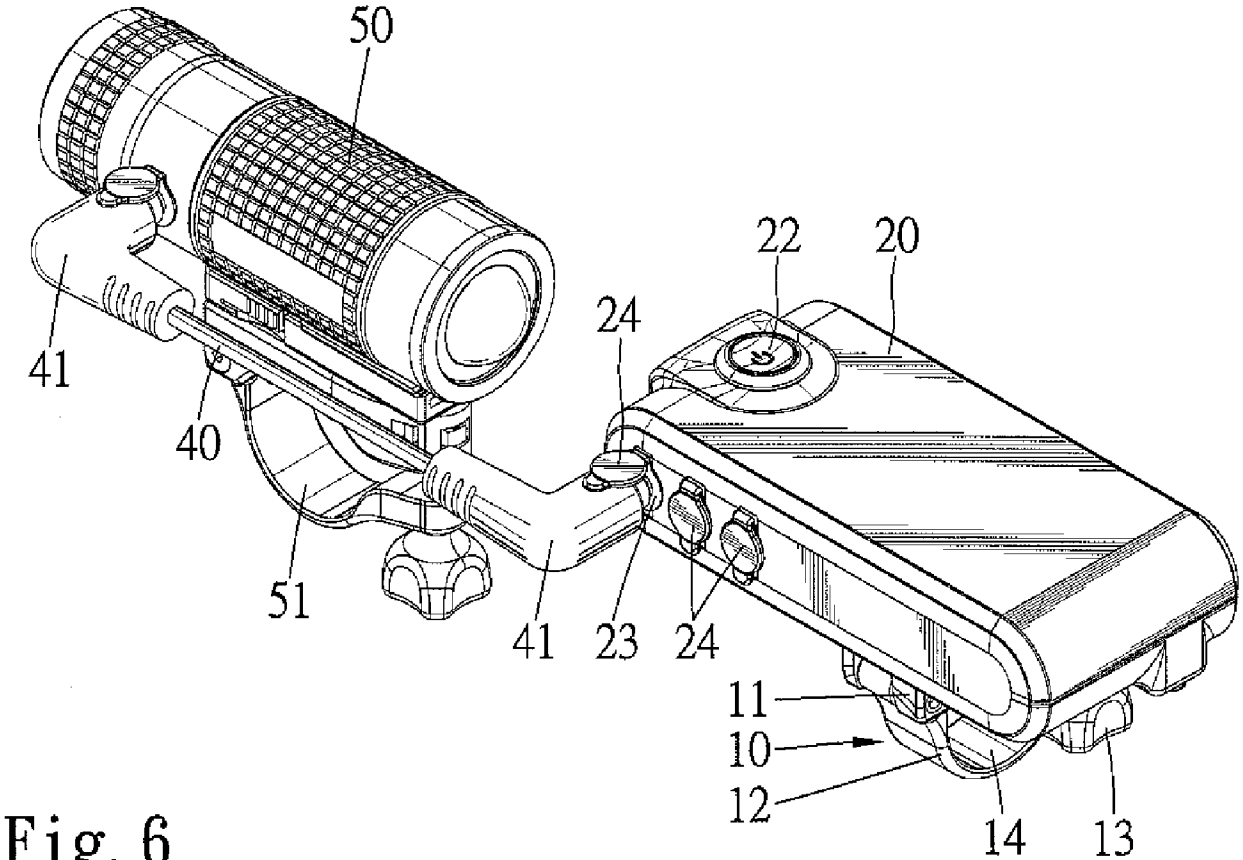
FIG. 6 is a partial, enlarged view of FIG. 5 illustrating the quick connect/disconnect bicycle power pack embodying the present invention and connected to a flashlight.
Figure 7:
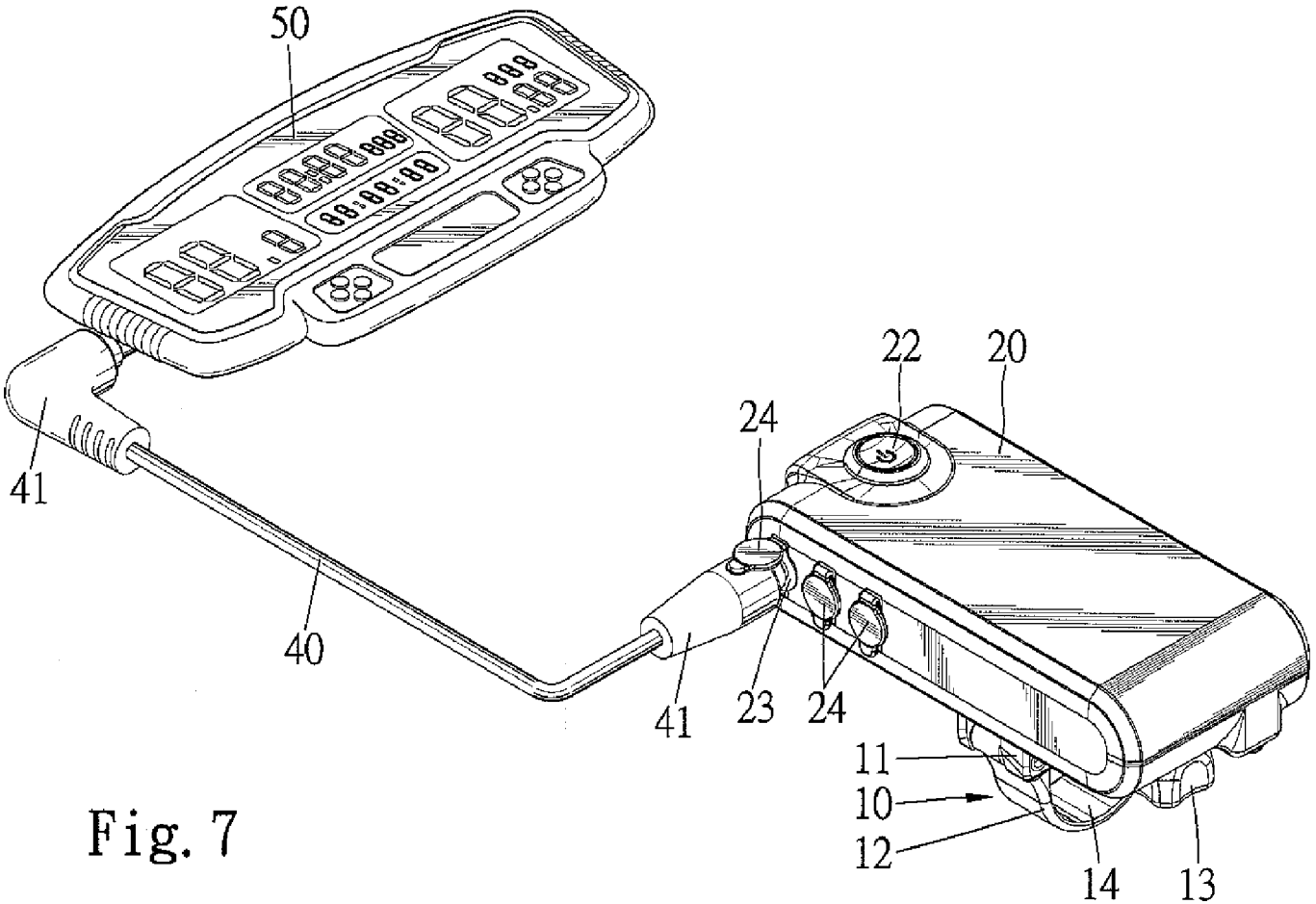
FIG. 7 is a partial, enlarged view of FIG. 5 illustrating the quick connect/disconnect bicycle spare power pack connected to a stop watch.

Referring to FIG. 5, the mounting device 10 is fixed on the handlebar 31 of the bicycle 30, and the spare power pack 20 is connected to the mounting device 10. A flashlight 50, a stop watch 60 and a loudspeaker 70 are also fixed on the handlebar 31 by mounting devices 51, 61, 71 respectively. The mounting devices 51, 61, 71 are adapted for attachment/detachment of the flashlight 50, the stop watch and the loudspeaker 70 respectively. The flash light 50, the stop watch 60 and the loudspeaker 70 are electrically connected to the spare power pack 20 by three cables 40 respectively. Each cable 40 has two plugs 41 formed at two ends thereof respectively.

In view of forgoing, one advantage of the quick connect/disconnect bicycle power pack in accordance with the present invention is that the provision of the spare power pack 20 that is adapted to connect to and supply electricity to a plurality of electrically-powered accessories. In the preferred embodiment, the flashlight 50, the stop watch 60 and the loudspeaker 70 are connected to the spare power pack 20.

Another advantage of the present invention is the provision of the spare power pack 20 that is adapted for quick attachment/detachment with the bicycle 30.

While the specific embodiments have been illustrated and described, numerous modifications come to mind without significantly departing from the spirit of invention and the scope of invention is only limited by the scope of accompanying claims.

What is claimed is:

1. A quick connect/disconnect bicycle power pack comprising:

a mounting device adapted for quick attachment/detachment with a handlebar of a bicycle, wherein said mounting device includes a clipping member formed thereon;

a spare power pack including a mounting portion adapted for quick attachment/detachment with said clipping member, and with said spare power pack being adapted to quickly connect to and supply electricity to a plurality of electrically-powered accessories, wherein the spare power pack includes a plurality of outlets; and a plurality of cables receivable in the plurality of outlets, with said plurality of cables adapted to connect to a plurality of electrically-powered accessories respectively.

2. A quick connect/disconnect bicycle power pack as claimed in claim 1 wherein said mounting portion of said spare power pack includes an engaging recess, with said clipping member being slidably engageable with said engaging recess.

3. A quick connect/disconnect bicycle power pack as claimed in claim 2 wherein said mounting portion includes a biasing member, with said engaging recess including a locking member disposed therein, with said clipping member including an engaging slot, with said locking member engageable with said engaging slot, and with said locking member being biased to disengage from said engaging slot by said biasing member.

4. A quick connect/disconnect bicycle power pack as claimed in claim 1 wherein one of said plurality of electrically-powered accessories is a flashlight.

5. A quick connect/disconnect bicycle power pack as claimed in claim 1 wherein one of said plurality of electrically-powered accessories is a stop watch.

6. A quick connect/disconnect bicycle power pack as claimed in claim 1 wherein one of said plurality of electrically-powered accessories is a loudspeaker.

7. A quick connect/disconnect bicycle power pack as claimed in claim 1 wherein said mounting device includes a saddle and a brace, with said saddle including a first end and a second end, with said first end of the saddle being pivotally connected to said brace such that said second end of the saddle pivotally moves between various positions relative to said brace, and with said mounting device further including a fastener, with said fastener being adapted to insert through said brace and said second end of the saddle and thereby fixing the mounting device to the bicycle.

8. A quick connect/disconnect bicycle power pack as claimed in claim 7 wherein said fastener includes a threaded section.

9. A quick connect/disconnect bicycle power pack as claimed in claim 1 wherein said spare power pack includes a power switch for turning on/off said spare power pack.

10. A quick connect/disconnect bicycle power pack as claimed in claim 1 wherein said plurality of outlets include a plurality of protective covers respectively for preventing foreign matter from getting into said plurality of outlets.

11. A quick connect/disconnect bicycle power pack comprising:

a mounting device adapted for quick attachment/detachment with a handlebar of a bicycle, wherein said mounting device includes a clipping member formed thereon; and a spare power pack including a mounting portion adapted for quick attachment/detachment with said clipping member, and with said spare power pack being adapted to connect to and supply electricity to a plurality of electrically-powered accessories;

wherein the mounting portion of said spare power pack includes an engaging recess, with said clipping member being slidably engageable with said engaging recess; and wherein the mounting portion includes a biasing member, with said engaging recess including a locking member disposed therein, with said clipping member including an engaging slot, with said locking member engageable with said engaging slot, and with said locking member being biased to disengage from said engaging slot by said biasing member.

12. The quick connect/disconnect bicycle power pack as claimed in claim 11 wherein said spare power pack includes a power switch for turning on/off said spare power pack.

13. The quick connect/disconnect bicycle power pack as claimed in claim 11 further comprising a plurality of outlets, with the plurality of outlets including a plurality of protective covers respectively for preventing foreign matter from getting into said plurality of outlets.

14. A quick connect/disconnect bicycle power pack comprising:

a mounting device adapted for quick attachment/detachment with a handlebar of a bicycle, wherein said mounting device includes a clipping member formed thereon; and a spare power pack including a mounting portion adapted for quick attachment/detachment with said clipping member, and with said spare power pack being adapted to connect to and supply electricity to a plurality of electrically-powered accessories;

wherein said mounting device includes a saddle and a brace, with said saddle including a first end and a second end, with said first end of the saddle being pivotally connected to said brace such that said second end of the saddle pivotally moves between various positions relative to said brace, and with said mounting device further including a fastener, with said fastener being adapted to insert through said brace and said second end of the saddle and thereby fixing the mounting device to the bicycle; and wherein said fastener includes a threaded section.

15. The quick connect/disconnect bicycle power pack as claimed in claim 14 wherein said spare power pack includes a power switch for turning on/off said spare power pack.

16. The quick connect/disconnect bicycle power pack as claimed in claim 14 further comprising a plurality of outlets, with the plurality of outlets including a plurality of protective covers respectively for preventing foreign matter from getting into said plurality of outlets.

* * * * *